US009442426B2

(12) United States Patent
Akedo

(10) Patent No.: US 9,442,426 B2
(45) Date of Patent: Sep. 13, 2016

(54) DEVELOPING APPARATUS AND IMAGE FORMING APPARATUS USING THE SAME

(71) Applicant: SHARP KABUSHIKI KAISHA, Osaka-shi, Osaka (JP)

(72) Inventor: Shuichi Akedo, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 34 days.

(21) Appl. No.: 14/533,427

(22) Filed: Nov. 5, 2014

(65) Prior Publication Data

US 2015/0241813 A1 Aug. 27, 2015

(30) Foreign Application Priority Data

Feb. 27, 2014 (JP) ..... 2014-036269

(51) Int. Cl.
*G03G 15/08* (2006.01)

(52) U.S. Cl.
CPC ..... *G03G 15/0893* (2013.01); *G03G 15/0879* (2013.01); *G03G 2215/0132* (2013.01)

(58) Field of Classification Search
CPC ..... G03G 15/0865; G03G 2215/0819; G03G 15/0893
See application file for complete search history.

(56) References Cited

U.S. PATENT DOCUMENTS

| | | | | |
|---|---|---|---|---|
| 7,676,184 | B2 * | 3/2010 | Murayama et al. | 399/260 |
| 7,715,764 | B2 | 5/2010 | Aimoto | |
| 2005/0265759 | A1 * | 12/2005 | Takeuchi et al. | 399/359 |
| 2007/0104515 | A1 * | 5/2007 | Akedo | 399/254 |
| 2008/0112731 | A1 * | 5/2008 | Aimoto | 399/254 |
| 2010/0183341 | A1 * | 7/2010 | Ikeda | 399/255 |
| 2012/0014719 | A1 * | 1/2012 | Hayashi | G03G 15/0853 399/254 |

FOREIGN PATENT DOCUMENTS

| | | | |
|---|---|---|---|
| JP | 10-142916 | A | 5/1998 |
| JP | 2000-118676 | A | 4/2000 |
| JP | 2002-6631 | A | 1/2002 |
| JP | 2002-365909 | A | 12/2002 |
| JP | 2008-122547 | | 5/2008 |
| JP | 2010-54648 | A | 3/2010 |
| JP | 2011-22346 | A | 2/2011 |

* cited by examiner

*Primary Examiner* — Sandra Brase
(74) *Attorney, Agent, or Firm* — Nixon & Vanderhye P.C.

(57) ABSTRACT

An image forming apparatus includes a developing apparatus that develops a toner image on a photoreceptor drum. In the developing apparatus, a first transporting member that transports a developer stored in a developer vessel while churning and a second transporting member are provided in parallel with each other, and the developer that is transported by the first transporting member is supplied to a developing roller from the second transporting member. The first transporting member churns a new toner and carrier that are resupplied with the developer. In the second transporting member, the developer that a waste toner passing a developing process is churned and the developer that the new toner being resupplied is churned are face and collide with each other. Accordingly, the new toner gets into the developer.

8 Claims, 8 Drawing Sheets

DEVELOPING APPARATUS AND IMAGE FORMING APPARATUS USING THE SAME

CROSS REFERENCE OF RELATED APPLICATION

The disclosure of Japanese patent application No. 2014-036269 filed on Feb. 27, 2014 is incorporated by reference.

BACKGROUND OF THE INVENTION

1. Field of the Invention

The present invention relates to a developing apparatus and an image forming apparatus using the same, and more specifically, a developing apparatus and an image forming apparatus using the same, developing a toner image on a photoreceptor.

2. Description of the Related Art

One example of a related art is disclosed in Japanese patent application laying-open No. 2008-122547 [G03G 15/06] (Literature 1) laid-open on May 29, 2008. In a developing apparatus disclosed in Literature 1, there is a provided with a first churning member that transports a developer to supply a magnet roller while churning, and in the first churning member, the developer is transported from both ends toward the center so as to collides near the center that a toner resupplying port is provided. Due to such collision, a pulsating flow of the developer occurs. By this pulsating flow, a toner that is resupplied to the toner resupplying port and the developer are mixed with each other.

However, in the above-described related art, since a toner is resupplied at a place that a developer stays like a pulsating flow, the toner only slides down a slope formed by the pulsating flow without mixing with the developer. That is, the toner that is resupplied does not get into the developer. Accordingly, since the toner and the developer cannot be sufficiently mixed, the toner becomes charging degradation thereby to cause toner scattering and fogging.

SUMMARY OF THE INVENTION

Therefore, it is a primary object of the present invention to provide a novel developing apparatus and an image forming apparatus using the same.

It is another object of a present invention to provide a developing apparatus and an image forming apparatus using the same, capable of preventing toner scattering and fogging.

A developing apparatus of a first invention comprises a first supplying portion that transports a first toner that is resupplied and a developer stored in a developer vessel while churning so as to supply to a developer bearing member; and a second supplying portion that transports a second toner different from the first toner that is resupplied and a developer while churning so as to supply to the first supplying portion. In the developing apparatus, the developer that is transported and churned with the first toner and the developer that is supplied to the first supplying portion by the second supplying portion face and collide with each other.

According to the first invention, since the developer that the first toner that is resupplied and the developer that is stored in the developer vessel are churned and the developer that is churned with the second toner different from the first toner that is resupplied face and collide with each other, it is possible to make the new toner that is resupplied get into the developer that is churned with the waste toner passing a developing process, for example. That is, since mixing performance and churning performance improve, it is possible to charge the toner sufficiently and uniformly and thus prevent toner scattering and fogging from occurring.

In a second invention, the developing apparatus further comprises a first transporting member, a second transporting member and a partitioning plate. The first transporting member transports the developer in a first direction in a first transporting path and in a second direction opposite to the first direction in the first transporting path. The second transporting member turns up and transports the developer that is transported in the first direction by the first transporting member in a second direction in a second transporting path that is formed in parallel with the first transporting path so as to supply to the developer bearing member, and turns up and transports the developer that is transported in the second direction by the first transporting member in the first direction in the second transporting path. The partitioning plate partitions the first transporting path and the second transporting path, and is formed with notches at a position that the developer is turned up and a position that the developers collide, respectively. The first transporting path and the second transporting path are communicated with each other by the notches.

According to the second invention, the first supplying portion and the second supplying portion can be constructed by providing the first transporting member, the second transporting member and the partitioning plate.

In the developing apparatus of a third invention, the first toner is a waste toner passing a developing process and the second toner is a new toner that is resupplied from a toner cartridge.

According to the third invention, since the new toner that is resupplied is made to collide with the developer that the waste toner is churned, it is possible to make the toner that is resupplied get into the developer that the waste toner is churned. Accordingly, the toner can be charged sufficiently and uniformly.

In the developing apparatus of a fourth invention, a first resupplying port for resupplying a new toner is formed in an upstream side than the position that the developer that is transported by the first supplying portion and the developer that is transported by the second supplying portion collide with each other within the first transporting path that the developer is transported by the first transporting member in the second direction, and turned up, and then transported by the second transporting member in the first direction.

According to the fourth invention, since the first resupplying port for resupplying a new toner is formed in an upstream side than the position that makes the developers collide with each other, it is possible to preliminarily churn the new toner that is resupplied with the developer.

In the developing apparatus of a fifth invention, the first transporting member has an agitator for transporting the developer while churning, and a part of agitating vanes is lacked near the position that makes the developers collide.

According to the fifth invention, by lacking a part of the agitating vanes, it is possible to stay the developer mixed by collision in at least a portion that a part of the agitating vanes is lacked. Accordingly, the new toner and the developer can be churned more.

In the developing apparatus of a sixth invention, the first transporting member has an agitator for transporting the developer while churning. Then, the first transporting member is provided with a first plate near the position that makes the developers collide, the first plate being formed in an agitator groove to be extended radially from a center of an agitator shaft and arranged in parallel with the agitator shaft.

According to the sixth invention, by providing the first plate in a portion of the agitator groove, it is possible to stay the developer mixed by collision in an upstream side than the position that the first plate is provided in the transporting direction of the developer. Accordingly, the new toner and the developer can be churned more.

In the developing apparatus of a seventh invention, a wall having a surface perpendicular to the partitioning plate is provided at a position that the notch is formed corresponding to the position that the developers collide. Accordingly, the developer mixed by collision is more separated (returned) to a side of the second supplying portion in comparison with a case of no wall.

According to the seventh invention, since the developer mixed by collision is more separated to the second supplying portion in comparison with a case of no wall, the number of times that the developer is preliminarily churned and the amount of the developer churned preliminarily increase. Accordingly, the new toner and the developer can be churned more.

In the developing apparatus of an eighth invention, a second plate is provided in an upstream side of a position that makes the developer that is transported by the first supplying portion and the developer that is transported by the second supplying portion collide with each other within the first transporting path, the second plate being radially extended from a center of an agitator shaft at a portion of the agitator groove of the first transporting member or the second transporting member and arranged in parallel with the agitator shaft.

According to the eighth invention, since the paddle is provided in the transporting path that the developer is preliminarily churned, it is possible to make the developer stay in the upstream side of the paddle. Therefore, the number of times that the developer is preliminarily churned increases or an amount of the developer that is preliminarily churned increases. Accordingly, the new toner and the developer can be churned more.

In the developing apparatus of a ninth invention, the first toner is a new toner that is resupplied from a toner cartridge and the second toner is a waste toner passing a developing process.

In the ninth invention, like the third invention, since the new toner that is resupplied is made to collide with the developer that the waste toner is churned, it is possible to make the toner that is resupplied get into the developer that the waste toner is churned. Accordingly, the toner can be charged sufficiently and uniformly.

In the developing apparatus of a tenth invention, a first resupplying port for resupplying a new toner is formed in an upstream side than a position that the developer that is transported by the first supplying portion and the developer that is transported by the second supplying portion collide with each other within the second transporting path that the developer is transported by the first transporting member in the first direction, and turned up, and then transported by the second transporting member in the second direction.

According to the tenth invention, like the fourth invention, since the first resupplying port for resupplying a new toner is formed in an upstream side than the position that makes the developers collide with each other, it is possible to preliminarily churn the new toner that is resupplied with the developer.

In the developing apparatus of an eleventh invention, a filter member is provided in the first transporting path that the developer is transported by the first transporting member in the second direction, and turned up, and then transported by the second transporting member in the first direction. A second resupplying port for resupplying a waste toner is formed in an upstream side than a position that the filter member is provided within the second transporting path.

According to the eleventh invention, a contamination is removed by the filter member even if the contamination mixes when the waste toner is resupplied.

Furthermore, when the developer passes the filter member, a toner is loosened by the filter member to be distributed finely. Accordingly, churning efficiency improves.

A twelfth invention is an image forming apparatus using the developing apparatus of the first invention.

According to the twelfth invention, like the first invention, since toner scattering and fogging can be prevented from occurring, a printing quality of an output image improves.

The above described objects and other objects, features, aspects and advantages of the present invention will become more apparent from the following detailed description of the present invention when taken in conjunction with the accompanying drawings.

DETAILED DESCRIPTION OF NON-LIMITING EXAMPLE EMBODIMENTS

First Embodiment

Figure 1:
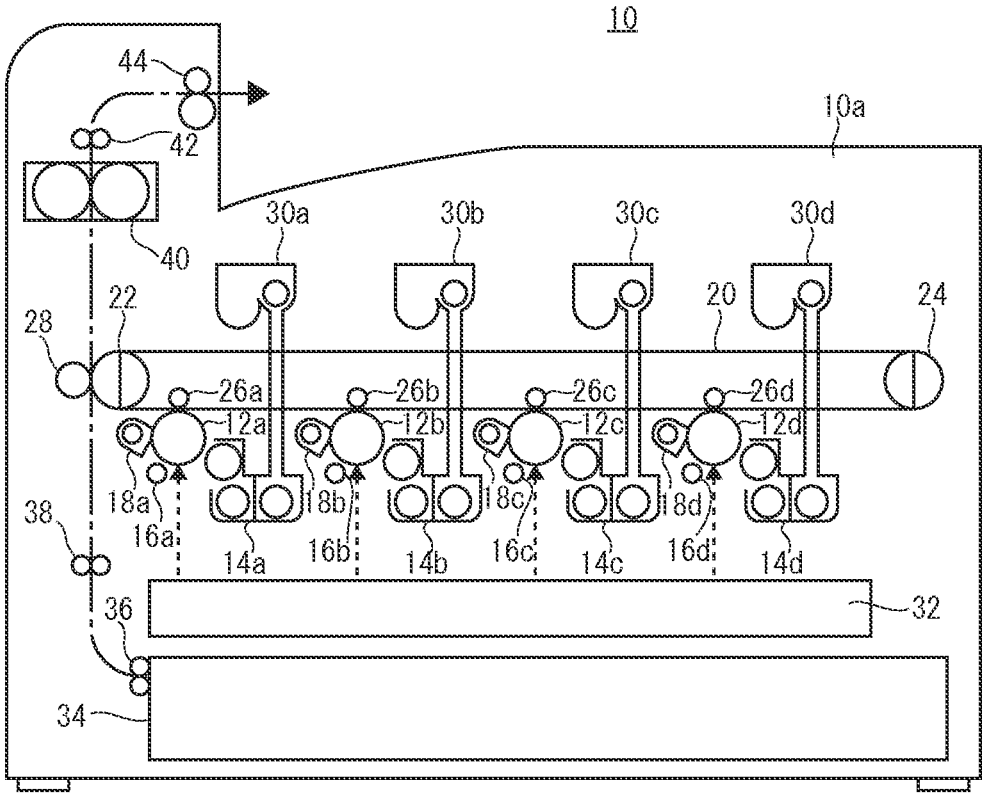
FIG. 1 is a view showing an example of an outline of whole structure of an image forming apparatus of a first embodiment.

FIG. 1 is a schematic structural view looking from the front a whole of an image forming apparatus 10 that is an embodiment according to the present invention.

With reference to FIG. 1, the image forming apparatus 10 of the first embodiment includes four photoreceptor drums 12*a*, 12*b*, 12*c* and 12*d*, and the photoreceptor drums 12*a*-12*d* are provided horizontally side-by-side. Developing apparatuses 14*a*, 14*b*, 14*c* and 14*d* are provided on right sides of the photoreceptor drums 12*a*, 12*b*, 12*c* and 12*d*. Furthermore, chargers 16*a*, 16*b*, 16*c* and 16*d* are provided diagonally left below the photoreceptor drums 12*a*, 12*b*, 12*c* and 12*d*. In addition, cleaning units 18*a*, 18*b*, 18*c* and 18*d* are provided on left sides of the photoreceptor drums 12*a*, 12*b*, 12*c* and 12*d*.

Furthermore, the image forming apparatus 10 includes an intermediate transfer belt 20 that is provided using a driving roller 22 and a driven roller 24 so as to be brought into contact with the photoreceptor drums 12*a*-12*d* at upper portions thereof. Perpendicular above the photoreceptor drums 12*a*, 12*b*, 12*c* and 12*d*, intermediate transfer rollers 26*a*, 26*b*, 26*c* and 26*d* are provided across the intermediate transfer belt 20. Furthermore, a transfer roller 28 is provided on a left side of the driving roller 22 across the intermediate transfer belt 20.

Above the intermediate transfer belt 20, toner cartridges 30*a*, 30*b*, 30*c* and 30*d* are arranged, and each of the toner cartridges 30*a*-30*d* is individually connected to corresponding each of the developing apparatuses 14*a*-14*d*.

Furthermore, an exposure device 32 is provided below the developing apparatuses 14*a*-14*d*, and a paper feeding tray 34 is further provided below the exposure device 32. A pickup roller 36 is provided in a left end portion of the paper feeding tray 34. Diagonally above the pickup roller 36, a feeding roller 38 is provided, and a fixing device 40 is provided above the feeding roller 38 via the driving roller 22 and the transfer roller 28. Furthermore, a transporting roller 42 is provided above the fixing device 40, and a paper discharge roller 44 is provided at right of the transporting roller 42.

Above-described respective components are accommodated in a housing 10*a* of the image forming apparatus 10, and as described later, a recording medium (typically "paper") having been formed with an image is discharged on an upper surface of the housing 10*a*.

The image forming apparatus 10 having such the structure is a full color printer, and can form a multicolor or monochromatic image on a recording medium according to image data that is input from an outside, for example. In addition, the image forming apparatus 10 does not need to be limited to a printer, and may be a copying apparatus, facsimile or a multifunction apparatus equipped with these functions. Accordingly, the image forming apparatus 10 can also form a multicolor or monochromatic image on a recording medium in accordance with not only image data that is input from the outside but also image data that is read from an original by a scanner.

Subsequently, an operation of the image forming apparatus 10 will be described.

As described above, the photoreceptor drums 12*a*-12*d*, the developing apparatuses 14*a*-14*d*, the chargers 16*a*-16*d*, the cleaning units 18*a*-18*d*, the intermediate transfer rollers 26*a*-26*d* and the toner cartridges 30*a*-30*d* are distinguished from each other by using subscripts "a"-"d". However, the components that the same numerals are applied have the same function and perform the same operation or action. Accordingly, it is thought that there is no necessity of distinguishing especially. Therefore, in the following, it is simply represented as the photoreceptor drum 12, the developing apparatus 14, the charger 16, the cleaning unit 18, the intermediate transfer roller 26 and the toner cartridge 30 by omitting the subscripts "a"-"d".

It should be noted that in FIG. 1 and its description, the subscript "a" is given to each component for performing image formation about black (K). Furthermore, the subscript "b" is given to each component for performing image formation about cyan (C). Furthermore, the subscript "c" is given to each component for performing image formation about magenta (M). Then, the subscript "d" is given to each component for performing image formation about yellow (Y).

For example, if printing is instructed, the photoreceptor drum 12 is charged with the charger 16. Next, the exposure device 32 forms an electrostatic latent image on a surface of the photoreceptor drum 12 according to input image data. Subsequently, the developing apparatus 14 develops the electrostatic latent image formed on the surface of the photoreceptor drum 12. That is, a toner image is formed. Then, the toner image thus formed on the surface of the photoreceptor drum 12 is transferred to the intermediate transfer belt 20 by the intermediate transfer roller 26. Subsequently, a toner remaining on the surface of the photoreceptor drum 12 is removed and collected by the cleaning unit 18.

In FIG. 1, the intermediate transfer roller 26 is rotated clockwise (right-handed rotation). Furthermore, the pickup roller 36 picks up a paper that is a recording medium from the paper feeding tray 34. The paper that is picked up is transported to the transfer roller 28 via the feeding roller 38.

Accordingly, the toner image that is transferred on the intermediate transfer belt 20 is transferred onto the paper with the transfer roller 28. Subsequently, the fixing device 40 fixes the toner image to the paper, and the paper that the toner image is fixed is discharged with the transporting roller 42 and the discharge roller 44.

In addition, in FIG. 1, a manual paper feeding tray and a feeding path that a paper laid in the manual paper feeding tray is fed are omitted. For example, the manual paper feeding tray is provided nearer the bottom from the center of a right side surface of the image forming apparatus 10 shown in FIG. 1, and a path that the paper is fed from the manual paper feeding tray is formed between the exposure device 32 and the paper feeding tray 34.

In such an image forming apparatus 10, a developer that the toner of black, cyan, magenta, or yellow and a carrier are mixed is stored in the developing apparatus 14. In addition, the carrier is a magnetic material such as iron powder and ferrite. The same is applied hereinafter.

For example, the developing apparatus 14 is a developing apparatus of a trickle development system, and a new toner (a second toner in the first embodiment) and carrier are resupplied from the toner cartridge 30. Furthermore, if the developer in a developer vessel 140 (see FIG. 4) increases due to the new toner and carrier that are resupplied, the carrier that is in excess or the developer (surplus developer) that the carrier that is in excess is mixed with the toner is discharged from the developer vessel 140. Thus, the carrier that deteriorated is replaced with a new carrier.

In such a developing apparatus 14, when the developer that is stored in the developer vessel 140 and a new toner that is resupplied are not mixed sufficiently (uniformly), the new toner that is resupplied becomes insufficient charging, and therefore, toner scattering and fogging occur.

In order to avoid such inconvenience, in the developing apparatus 14 of the first embodiment, a new toner that is resupplied and a developer including a toner passing a developing process are made to sufficiently mix, whereby the toner can be charged sufficiently and uniformly.

Figure 2:
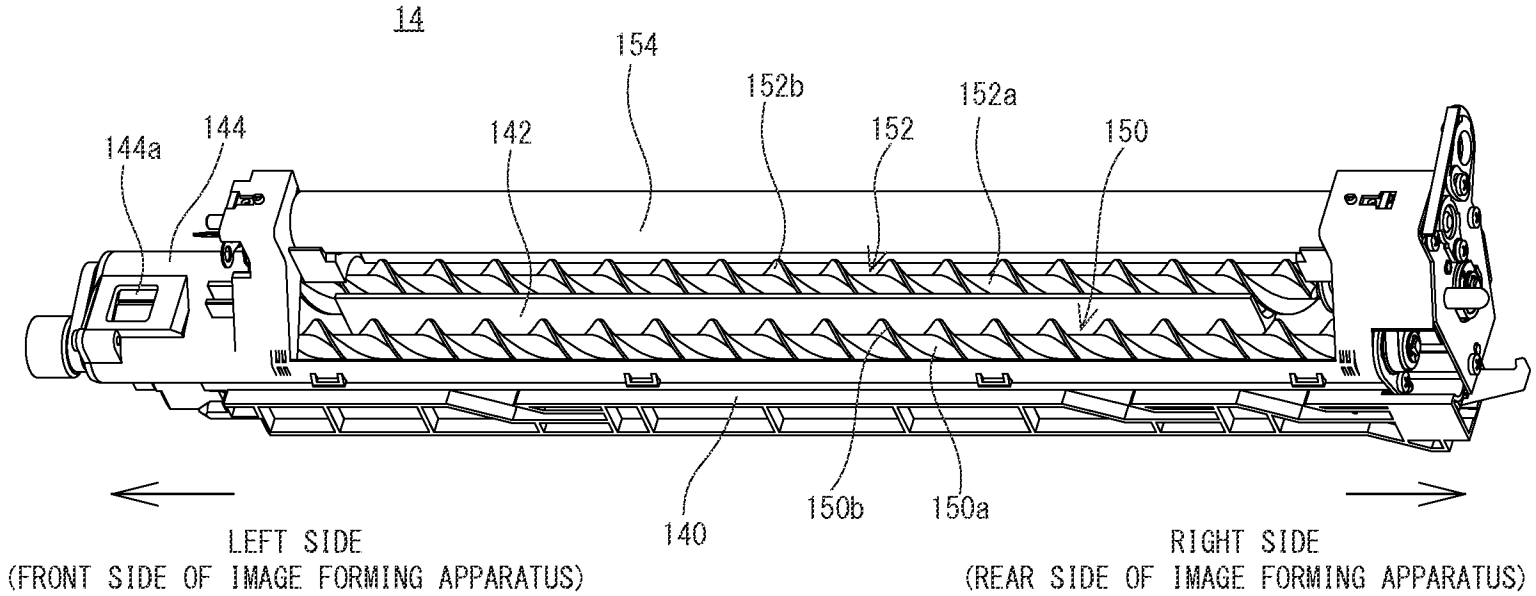
FIG. 2 is a perspective view specific appearance constitution of a developing apparatus shown in FIG. 1 viewed from diagonally upside.
Figure 3:
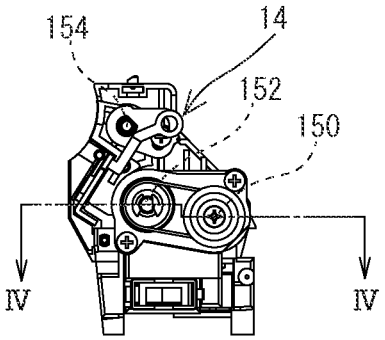
FIG. 3 is a side view the developing apparatus shown in FIG. 2 viewed from a left side surface.

In addition, the developing process means an operation that the developing apparatus 14 develops the electrostatic latent image formed on the surface of the photoreceptor drum 12, and the intermediate transfer roller 26 transfers the toner image that is formed on the surface of the photoreceptor drum 12 onto the intermediate transfer belt 20. Furthermore, the toner passing the developing process means a toner that remains on the surface of the photoreceptor drum 12 and is removed and collected by the cleaning unit 18 (a waste toner: a first toner in the first embodiment). FIG. 2 is a perspective view specific appearance constitution of the developing apparatus 14 shown in FIG. 1 viewed from diagonally upside. FIG. 3 is a side view of the developing apparatus 14 shown in FIG. 2 viewed from a left side surface. Furthermore, FIG. 4 is a sectional view of FIG. 3 at a line IV-IV.

In addition, in FIG. 2, a part of an upper cover 144 that covers a first transporting member 150, a second transporting member 152 and a developing roller 154 is omitted. Furthermore, a left side of the developing apparatus 14 shown in FIG. 2 is arranged in the front side of the image forming apparatus 10 shown in FIG. 1, and a right side of the developing apparatus 14 shown in FIG. 2 is arranged in the rear side of the image forming apparatus 10 shown in FIG. 1.

As shown in FIG. 2, the developing apparatus 14 includes a developer vessel 140 that is long horizontally and stores the developer (two-component developer) that the carrier and the toner are mixed, and the first transporting member 150, the second transporting member 152 and the developing roller (magnet roller) 154 are provided inside the developer vessel 140. However, the toner, the carrier and the developer that mixes them are not illustrated.

Figure 4:
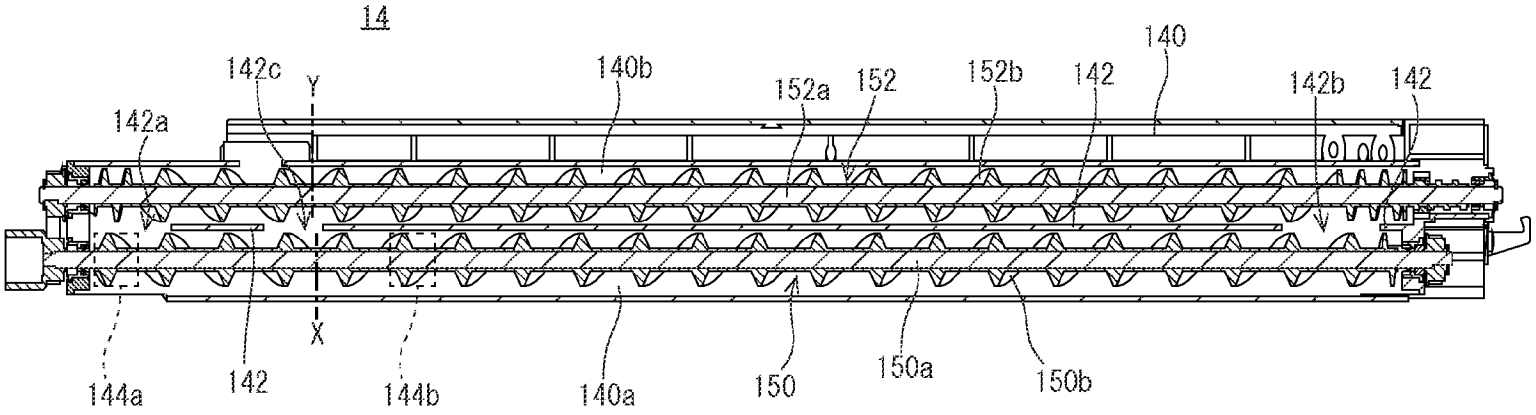
FIG. 4 is a sectional view of FIG. 3 at a line IV-IV.

Furthermore, as shown in FIG. 2-FIG. 4, the first transporting member 150 and the second transporting member 152 are arranged in parallel with each other below the developer vessel 140 in a rotatable manner. Between the first transporting member 150 and the second transporting member 152, a partitioning plate 142 that is extended in a longitudinal direction is provided. Accordingly, within the developer vessel 140, a first transporting path 140*a* that the developer is transported by the first transporting member 150 is formed, and a second transporting path 140*b* that the developer is transported by the second transporting member 150 is formed.

Furthermore, the partitioning plate 142 is formed with notches or slits 142*a* and 142*b* in both ends of the developer vessel 140, and a notch or slit 142*c* in the left from the center of the developer vessel 140. The first transporting path 140*a* and the second transporting path 140*b* can be communicated with each other by these notches or slits 142*a*-142*c*. That is, as describe later, the notches or slits 142*a*-142*c* are provided at positions that a transporting direction of the developer is turned up and a position that the developers collide (join) with each other.

Furthermore, the developing roller 154 is arranged in an upper portion of an inside of the developer vessel 140 and above the second transporting member 152. In this first embodiment, the developing roller 154 functions as a developer bearing member, and the developing roller 154 is arranged at a position opposite to the photoreceptor drum 12 (see FIG. 1). Accordingly, as described above, the developing roller 154 supplies a toner onto the surface of the photoreceptor drum 12 so as to develop (visualize) an electrostatic latent image that is formed on the surface of the photoreceptor drum 12.

Furthermore, as shown in FIG. 2, the developing apparatus 14 is formed with a toner resupplying port 144*a* that is for resupplying a new toner and carrier from the toner cartridge 30 in a left side end of the upper cover 144 and above the first transporting member 150. A transporting pipe extended from the toner cartridge 30 is connected with the toner resupplying port 144*a*. Although omitted in FIG. 2, the upper cover 144 is formed with a waste toner resupplying port 144*b* for resupplying a waste toner from the cleaning unit 18 above the first transporting member 150 nearer the center of the developing apparatus 14 than the slit 142*c* described later (see FIG. 4). A transporting pipe extended from the cleaning unit 18 is connected with the waste toner resupplying port 144*b*.

As shown in FIG. 2 and FIG. 4, the first transporting member 150 is an auger screw that vanes (agitating vanes 150*b*) for transporting the developer while churning are formed on a periphery of a rotation shaft (agitator shaft 150*a*). In the first transporting member 150, a direction that the agitating vanes 150*b* are wound is reversed at a position or near corresponding to a position that the slit 142*c* is formed. In FIG. 4 (FIG. 5 is also the same), the direction that the agitating vanes 150*b* are wound is reversed at a position X shown with a one-dotted line.

Similarly, the second transporting member 152 is an auger screw that agitating vanes 152*b* for transporting the developer while churning are formed on a periphery of an agitator shaft 152*a*. In the second transporting member 152, a direction that the agitating vanes 152*b* are wound is reversed at a position or near corresponding to a position that the slit 142*c* is formed. In FIG. 4 (FIG. 5 is also the same), the direction that the agitating vanes 152*b* of the second transporting member 152 are wound is reversed at a position Y shown with a one-dotted line.

In this first embodiment, the agitator shaft 150*a* of the first transporting member 150 and the agitator shaft 152*a* of the second transporting member 152 are rotated to reverse. As described above, in each of the first transporting member 150 and the second transporting member 152, the direction that each of the agitating vanes 150*b* and the agitating vanes 152*b* are wound is reversed at the position that the slit 142*c* is provided. Therefore, in the first transporting member 150, the developer is transported to both ends in a longitudinal direction of the developing apparatus 14 with centering the position that the winding direction of the agitating vanes 150*b* is reversed. On the other hand, in the second transporting member 152, the developer is transported from the both ends of in the longitudinal direction of the developing apparatus 14 toward the position that winding direction of the agitating vanes 152*b* is reversed. Furthermore, in portions that the slits 142*a* and 142*b* are provided, the developer is transported (pushed out) toward the second transporting path 140*b* from the first transporting path 140*a*, and the developer is transported toward the first transporting path 140*a* from the second transporting path 140*b* in the portion that the slit 142*c* is provided. That is, the developer is transported in a direction shown by arrow marks A, B, C, D, E, F and G in FIG. 5.

Figure 5:
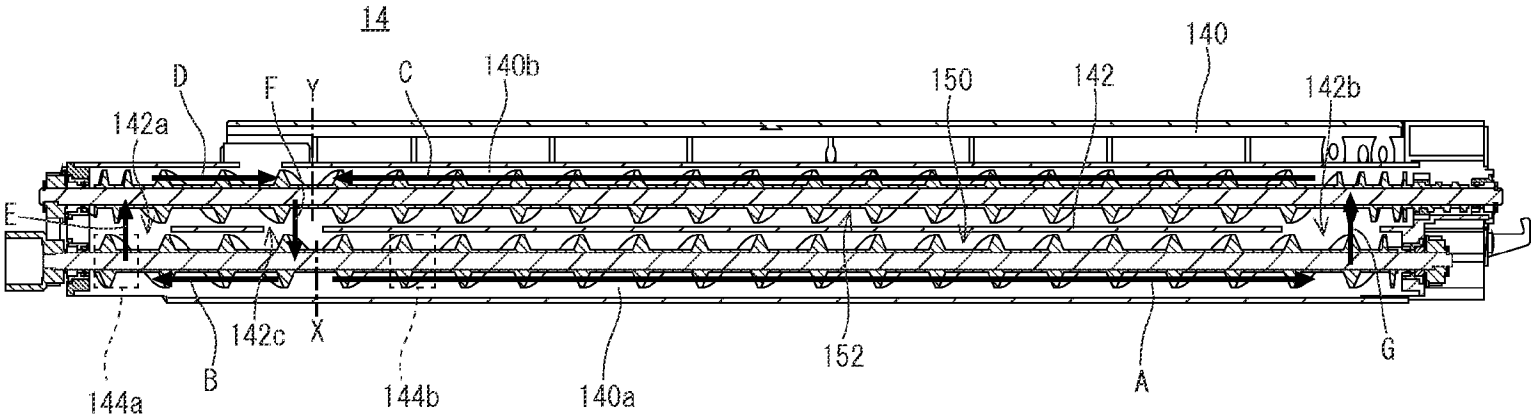
FIG. 5 is a view showing a flow of a developer in the developing apparatus shown in FIG. 4.

Specifically, the first transporting member 150 transports the developer in the direction (rightward in FIG. 5) shown by the arrow mark A and transports the developer in the direction shown by the arrow mark B (leftward in FIG. 5). Furthermore, in this first embodiment, the waste toner resupplying port 144*b* is formed above the first transporting member 150 (the first transporting path 140*a*) in slightly right of the position that the slit 142*c* is provided. Accordingly, the waste toner passing the developing process is resupplied (returned) to the first transporting path 140*a* from the waste toner resupplying port 144*b*, and is transported in the direction shown by the arrow mark A. That is, the developer that is transported in the direction shown by the arrow mark A includes the developer that churns the waste toner passing the developing process.

The developer that is transported in the direction shown by the arrow mark A is moved to the second transporting path 140*b* through the slit 142*b* in a right end portion of the first transporting path 140*a* as shown by the arrow mark G. Then, the toner is turned up to be transported in the direction shown by the arrow mark C (leftward in FIG. 5) within the second transporting path 140*b*. The developer that is transported in the direction shown by the arrow mark C is supplied to the developing roller 154.

On the other hand, the developer that is transported in the direction shown by the arrow mark B is moved to the second transporting path 140*b* through the slit 142*a* in a left end portion of the first transporting path 140*b* as shown by the arrow mark E. Then, the developer is turned up to be transported in the direction shown by the arrow mark D (rightward in FIG. 5) within the second transporting path 140*b*.

Accordingly, in near the position Y that the direction that the agitating vanes 152*b* of the second transporting member 152 are wound is reversed in the second transporting path 140*b*, the developer that is transported in the direction shown by the arrow mark C and the developer that is transported in the direction shown by the arrow mark D collide and mixes with each other. Then, the developer mixed by collision moves to the first transporting path 140*a* through the slit 142*c* as shown by the arrow mark F, and is separated in the direction shown by the arrow mark A and the direction shown by the arrow mark B. Accordingly, if the developing apparatus 14 shown in FIG. 5 is viewed perpendicularly as the left end coming to top, the developer is transported such that the character of 8 (eight) is written in the reverse stroke order.

Here, as described above, the toner resupplying port 144*a* is formed in the left end portion of the first transporting path 140*a*. Accordingly, a new toner from the toner cartridge 30 is resupplied in the left end portion of the first transporting path 140*a* together with a carrier, namely, from above the developer being transported in the direction shown in the arrow mark B, is moved to the second transporting path 140*b*, and is transported within the second transporting path 140*b* while being churned in the direction shown by the arrow mark D. Then, the developer that is transported in the direction shown by the arrow mark D while being churned with the new toner and carrier that are resupplied is made to collide in near the position Y with the developer that is transported in the direction shown by the arrow mark C. That is, the developer that is churned with the new toner that is resupplied and the developer that is churned with the waste toner passing the developing process face and collide with each other.

Accordingly, the new toner and carrier that are resupplied get into the developer mixed by collision, and then, are sufficiently churned and mixed with the developer during that the new toner and carrier transport within the first transporting path 140*a* according to the arrow mark A. Therefore, even when a new toner is resupplied from the toner resupplying port 144*a*, it is possible to charge the toner in the developer vessel 140 sufficiently and uniformly.

Thus, the new toner that is resupplied is preliminarily churned with the developer and collides with the developer that is churned with the waste toner passing the developing process, and thereafter, is transported in the direction shown by the arrow mark A to be supplied to the developing roller 154.

In addition, as described above, the developer mixed by collision is also transported in the direction shown in the arrow mark B. In such a case, since the new toner that is resupplied is preliminarily churned again with the developer, the new toner is churned and mixed with the developer more.

Furthermore, as described above, since the new toner that is resupplied is churned in advance with the developer, the new toner has only to collide with the developer passing the developing process, it is unnecessary to form a toner resupplying port 144*a* in the left end portion of the first transporting path 140*a*.

Figure 6:
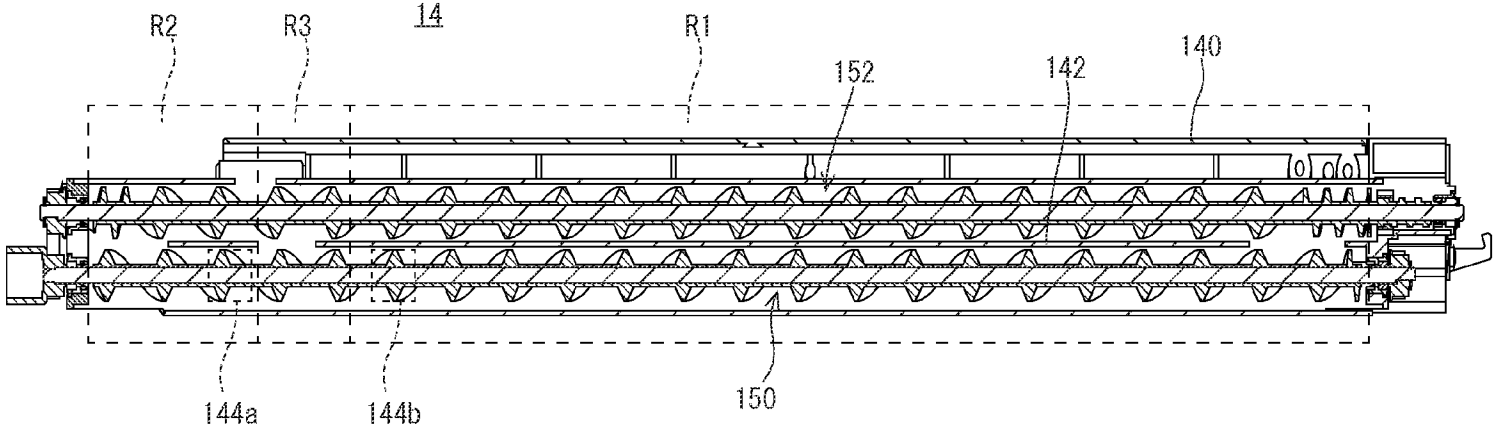
FIG. 6 is a sectional view of the developing apparatus for showing a position that a toner resupplying port is formed.

For example, as shown in FIG. 6, the developing apparatus 14 can be divided into a first supplying portion R1 that is for supplying the developer to the developing roller 154, a second supplying portion R2 that is for preliminarily churning the new toner that is resupplied with the developer so as to supply to the first supplying portion R1, and a mixture portion R3 that is formed between the first supplying portion R1 and the second supplying portion R2 and for making the developers from the first supplying portion R1 and the second supplying portion R2 collide (join) and for making the developers that are made to collide separate into the first supplying portion R1 and the second supplying portion R2.

Furthermore, although the developing roller 154 is not illustrated in FIG. 6, the first supplying portion R1 has a length equal to or approximately equal to a length of the developing roller 154 in a longitudinal direction of the developing apparatus 14. In addition, the second supplying portion R2 and the mixture portion R3 are formed in a region except the first supplying portion R1. Thus, the agitating vanes 150*b* of the first transporting member 150 and the agitating vanes 152*b* of the second transporting member 152 are formed such that the first supplying portion R1, the second supplying portion R2 and the mixture portion R3 can be formed.

Accordingly, if the toner resupplying port 144*a* is arranged above the transporting path the developer is transported in the second supplying portion R2, the new toner that is resupplied can be preliminarily churned with the developer, and after collision with the developer that is transported from the first supplying portion R1 in the mixture portion R3, can be supplied to the first supplying portion R1. Therefore, it is also possible to provide the toner resupplying port 144*a* above the left end portion of the second transporting member 152 (the second transporting path 140*b*). However, in order to preliminarily churn the new toner that is resupplied for a long time with the developer, as shown in FIG. 6, it is necessary to arrange the toner resupplying port 144*a* in an upstream side of the transporting path.

Furthermore, if the waste toner resupplying port 144*b* is arranged above the transporting path that the developer is transported in the first supplying portion R1, it is possible to make the waste toner collide with the developer that the new toner that is resupplied is preliminarily churned. In addition, in order to charge the waste toner that is resupplied sufficiently and uniformly, the waste toner resupplying port 144*b* is to be arranged in an upstream side of the transporting path that the developer is transported in the first supplying portion R1 to lengthen a time period that the waste toner and the developer are churned.

In addition, although the developing apparatus 14 is divided into the first supplying portion R1, the second supplying portion R2 and the mixture portion R3 in the first embodiment, the mixture portion R3 may be included in the first supplying portion R1 or the second supplying portion R2.

According to the first embodiment, since the new toner that is churned in advance with the developer that is stored in the developer vessel 140 and the developer that the waste toner passing the developing process is churned are made to face and collide with each other, it is possible to get the new toner into the developer. Accordingly, even when a new toner is resupplied from the toner resupplying port 144*a*, the toner within the developer vessel can be charged sufficiently and uniformly, and thus, it is possible to prevent toner scattering and fogging from occurring. Therefore, in the image forming apparatus 10, a printing quality of an output image can be increased.

Second Embodiment

Since an image forming apparatus 10 of the second embodiment is the same as the first embodiment except changing a part of structure of the developing apparatus 14, a duplicate description is omitted.

Briefly describing, in the second embodiment, after making the new toner that is preliminarily churned and the developer that the waste toner passing the developing process is churned collide, the developer mixed by collision is made to stay near the slit 142*c*. By doing in this way, it is possible to expedite churning of the new toner.

Figure 7:
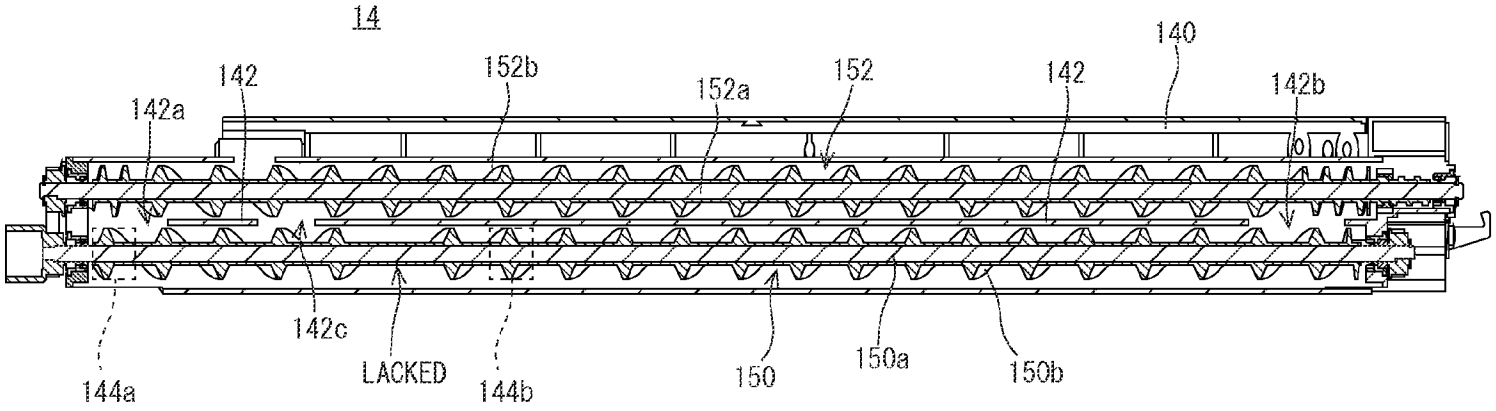
FIG. 7 is a sectional view of a developing apparatus in a second embodiment.

Specifically, as shown in FIG. 7, a part of the agitating vanes 150*b* of the first transporting member 150 is lacked on a position slightly rightward from a position corresponding to the position that the slit 142*c* is provided. In other words, a pitch of the agitating vanes 150*b* is lengthened in the part concerned. Accordingly, the developer mixed by collision becomes hard to be transported in the direction shown by the arrow mark A of the first transporting path 140*a*, and is made to stay near the slit 142*c*. That is, it is possible to make the developer mixed by collision stay at least in a portion that a part of the agitating vanes 150*b* is lacked.

In addition, in the second embodiment, since the developer is made to stay in the portion that the part of the agitating vanes 150*b* of the first transporting path 140*a* is lacked, the waste toner resupplying port 144*b* is provided at a position slightly shifted from this portion toward a downstream side of the transporting direction. This is for preventing the waste toner from being resupplied toward the mixture portion R3 and the second supplying portion R2 while sliding over the developer that is made to stay. This is true in the third embodiment describe later.

According to the second embodiment, since the new toner that is resupplied is made to stay after collision with the developer that the waste toner passing the developing process is churned, the new toner can be churned more before supplied to the developing roller 154. Accordingly, since the toner is stably charged, it is possible to prevent toner scattering and fogging more effectively.

Third Embodiment

Since an image forming apparatus 10 of the third embodiment is the same as the image forming apparatus 10 of the second embodiment except providing a paddle in an agitator groove instead that a part of the agitating vanes 150*b* is lacked, a duplicate description is omitted.

Figure 8:
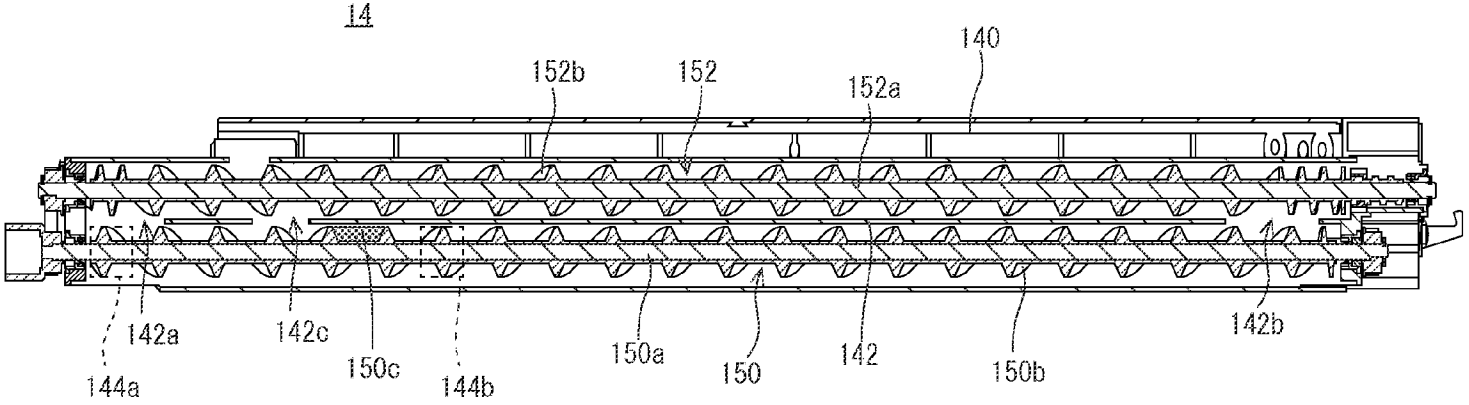
FIG. 8 is a sectional view of a developing apparatus in a third embodiment.

As shown in FIG. 8, in the developing apparatus 14 of the third embodiment, a plate or paddle (first plate or paddle) 150*c* is provided on slightly right of a position corresponding to the position that the slit 142*c* is formed within the agitator groove, and the plate or paddle 150*c* is radially extended from the center of the agitator shaft 150*a* and arranged in parallel with the agitator shaft 150*a*. In this way, as similar to the second embodiment, it is possible to make the developer mixed by collision stay near the slit 142*c*, that is, in an upstream side of the direction shown by the arrow mark A than the position that the plate (paddle) 150*c* of the first transporting path 140*a* is provided.

In addition, in FIG. 8 (also in FIG. 10), in order to show clearly, the paddle 150*c* is splashed.

Furthermore, in the third embodiment, although only one paddle 150*c* is provided in one agitator groove, not limited to this. For example, a plurality of paddles 150*c* may be provided in one agitator groove with being shifted around the shaft.

Furthermore, one or more paddles 150*c* may be provided in a plurality of agitator grooves. However, as described above, the paddle 150*c* is provided near the slit 142*c* on slightly right thereof in the agitator groove.

According to the third embodiment, since the developer mixed by collision is made to stay in an upstream side by providing the paddle 150*c*, like the second embodiment, it is possible to more churn the new toner that is resupplied and developer prior to supplying to the developing roller 154. Accordingly, since the toner is stably charged, it is possible to prevent toner scattering and fogging more effectively.

Fourth Embodiment

Since an image forming apparatus 10 of the fourth embodiment is the same as the first embodiment except changing a part of structure of the developing apparatus 14, a duplicate description is omitted.

In brief, in the fourth embodiment, the number of times of preliminary churning of the developer increases or an amount of the developer that is churned preliminarily increases.

Figure 9:
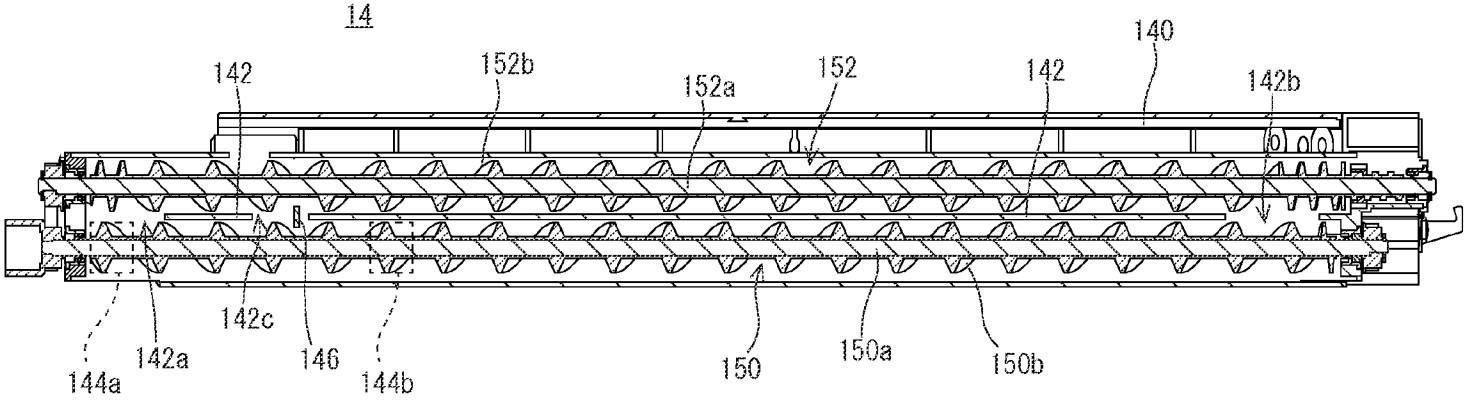
FIG. 9 is a sectional view of a developing apparatus in a fourth embodiment.

Specifically, as shown in FIG. 9, a wall 146 having a surface perpendicular to the partitioning plate 142 is formed in the position that the slit 142*c* is formed to the right. Accordingly, in comparison with a case of no wall 146, the developer mixed by collision can increase an amount to be transported (separated) in the direction shown by the arrow mark B in the first transporting path 140*a*. Accordingly, it is possible to increase the number of times of churning the developer preliminarily or the amount of the developer churned preliminarily. Therefore, the toner that is resupplied and the developer can uniformly mix to some extent in the second supplying portion R2. That is, the new toner that is resupplied and the developer that is stored in the developer vessel 140 can be uniformly charged to some extent in the second supplying portion R2.

According to the fourth embodiment, since the number of times of churning the developer preliminarily is increased or the quantity of the developer churned preliminarily is increased, like the second embodiment and the third embodiment, it is possible to churn more the new toner that is resupplied and the developer. Accordingly, since the toner is stably charged, it is possible to prevent toner scattering and fogging more effectively.

Fifth Embodiment

Since an image forming apparatus 10 of the fifth embodiment is the same as the first embodiment except changing a part of structure of the developing apparatus 14, a duplicate description is omitted.

In brief, in the fifth embodiment, a time period of preliminary churning is lengthened.

Figure 10:
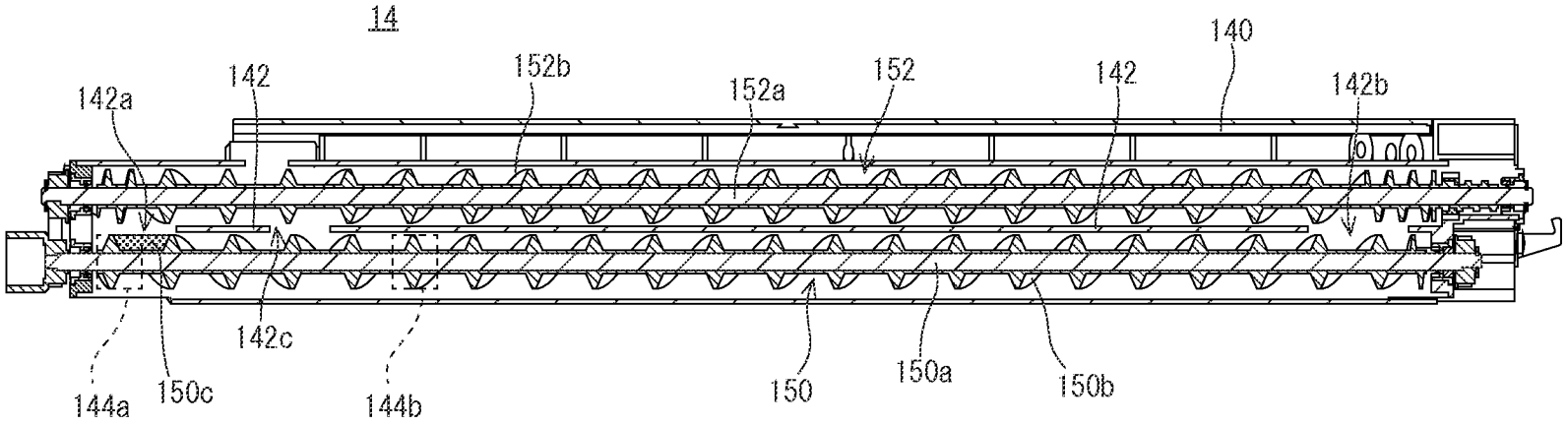
FIG. 10 is a sectional view of a developing apparatus in a fifth embodiment.

Specifically, as shown in FIG. 10, a plate or paddle (second plate or paddle) 150*c* is provided in the left end portion of the first transporting member 150. Accordingly, in the second supplying portion R2 shown in FIG. 6, the developer is made to stay in an upstream side of a position that the paddle 150*c* is provided in the transporting path that the developer is transported. Accordingly, it is possible to lengthen a time period that the developer is churned preliminarily. Therefore, the toner that is resupplied and the developer can be mixed to some extent prior to collision. In addition, the position of the agitator groove that the paddle 150*c* is provided and the number of the paddles do not need to be limited. For example, as long as within the second supplying portion R2 shown in FIG. 6, a paddle may be provided on the second transporting member 152, and the paddle may be provided in both the first transporting member 150 and the second transporting member 152. Furthermore, a plurality of paddles may be proved in one agitator groove.

According to the fifth embodiment, since a time period to churn preliminarily is lengthened, like the second embodiment to the fourth embodiment, it is possible to churn more the new toner that is resupplied and the developer. Accordingly, since the toner is stably charged, it is possible to prevent toner scattering and fogging more effectively.

In addition, although a paddle is provided on the transporting path that the preliminary churning is performed to lengthen a time period to churn preliminarily in the fifth embodiment, if it is possible to make the developing apparatus 14 long in a horizontal direction, the transporting path that the preliminary churning is performed itself may be lengthened.

Furthermore, as to changes of the structure of the developing apparatus 14 shown in the second embodiment, the fourth embodiment and the fifth embodiment, any two or more among them may be simultaneously adopted.

Furthermore, as to changes of the structure of the developing apparatus 14 shown in the third embodiment to the fifth embodiment, any two or more among them may be adopted simultaneously.

Sixth Embodiment

Since an image forming apparatus 10 of the sixth embodiment is the same as the first embodiment except changing a part of structure of the developing apparatus 14, a duplicate description is omitted.

Briefly describing, in the sixth embodiment, the new toner and carrier may be supplied to the first supplying portion R1, and the waste toner may be supplied to the second supplying portion R2.

Figure 11:
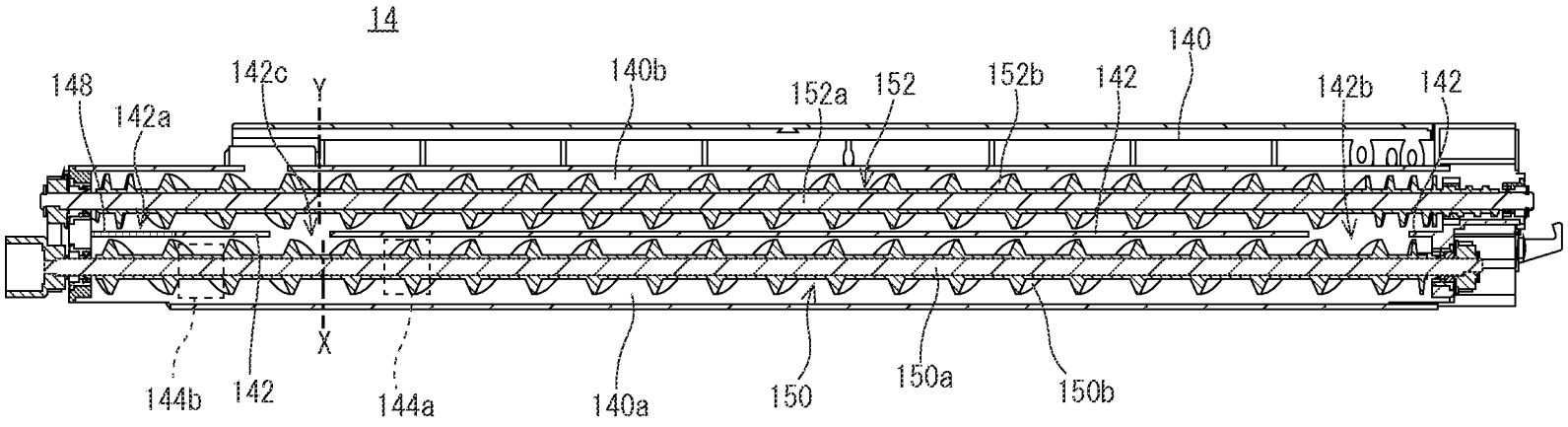
FIG. 11 is a sectional view of a developing apparatus according to another embodiment and showing arrangement of a waste toner resupplying port on an upstream side of a transporting direction of a developer.

Specifically, a toner resupplying port 144*a* and a waste toner resupplying port 144*b* are replaced. Furthermore, in an example shown in FIG. 11, a waste toner resupplying port 144*b* is arranged in an upstream side of the transporting direction of the developer in the second supplying portion R2 than a position that the toner resupplying port 144*a* shown in the first embodiment is provided.

Accordingly, a new toner (first toner in the sixth embodiment) and carrier from the toner cartridge 30 are resupplied to an upstream side of the transporting direction of the developer in the first supplying portion R1, and transported in the first transporting path 140*a* while being churned toward a direction that the slit 142*b* is formed, and pushed out to the second transporting path 140*b* via the slit 142*b*, and thereafter, transported in the second transporting path 140*b* while being churned toward a direction that the slit 142*c* is formed.

On the other hand, a waste toner (second toner in the sixth embodiment) from the cleaning unit 18 is resupplied to an upstream side of the transporting direction of the developer in the second supplying portion R2, and transported in the first transporting path 140*a* while being churned toward a direction that the slit 142*a* is formed, and pushed out to the second transporting path 140*b* via the slit 142*a*, and thereafter, transported in the second transporting path 140*b* while being churned toward a direction that the slit 142*c* is formed.

Accordingly, in such a case, the developer churned with the new toner and the developer churned with the waste toner face and collide with each other.

Therefore, the new toner and carrier that are resupplied get into the developer mixed by collision, and thereafter, may be sufficiently churned and mixed with the developer during transporting in the first transporting path 140*a* according to the arrow mark A.

Furthermore, in the sixth embodiment, a mesh (filter means) 148 is provided at the position of the slit 142*a*. Accordingly, the developer that the waste toner is churned is pushed out from the first transporting path 140*a* to the second transporting path 140*b* through the mesh 148. The mesh 148 has a mesh size larger than diameters of the toner, carrier and developer.

Therefore, a contamination is removed by the mesh 148 even if a contamination mixes when the waste toner is resupplied from the waste toner resupplying port 144*b*.

Furthermore, when the developer passes the mesh 148, the toner is loosened by the mesh 148 to be distributed finely.

In addition, although it is a matter of course, the waste toner resupplying port 144*b* is the transporting direction of the developer of the second supplying portion R2, and is arranged in an upstream side than the position that the mesh 148 is arranged.

In addition, a position that the mesh 148 is provided is only an example, and does not need to be limited. The mesh 148 may be provided at an arbitrary position as long as on the transporting path that the developer is transported in the second supplying portion R2 and in a downstream side than the position that the waste toner resupplying port 144*b* is formed. However, in a case where the mesh 148 is provided on the first transporting path 140*a* or the second transporting path 140*b*, it is necessary to penetrate the first transporting member 150 or the second transporting member 152 by opening a hole in the mesh 148.

According to the sixth embodiment, like the first embodiment, it is possible to sufficiently and uniformly charge the toner in the developer vessel, and thus, prevent toner scattering and fogging from occurring.

Furthermore, according to the sixth embodiment, because the developer that the waste toner is churned is passed the mesh 148, the toner is loosened while a contamination is removed. Therefore, churning efficiency improves.

In addition, as to changes of the structure of the developing apparatus 14 shown in the second embodiment to the fifth embodiment are applicable also to the sixth embodiment. In this case, as described above, any two or more of the changes of the structure of the developing apparatus 14 shown in the second embodiment, the fourth embodiment and the fifth embodiment may be simultaneously adopted in the sixth embodiment. Furthermore, any two or more of the changes of the structure of the developing apparatus 14 shown in the third embodiment to the fifth embodiment may be simultaneously adopted in the sixth embodiment.

In this way, while a new toner and carrier are sufficiently churned with the developer while being transported in the first supplying portion R1, and the waste toner is sufficiently churned with the developer while being transported in the second supplying portion R2.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A developing apparatus, comprising:

a first supplying portion that transports a developer that is stored in a developer vessel while churning so as to supply to a developer bearing member;

a second supplying portion that transports a toner that is resupplied and the developer while churning so as to supply to the first supplying portion, a first transporting member that transports the developer in a first direction in a first transporting path and in a second direction opposite to the first direction in the first transporting path;

a second transporting member that turns up and transports the developer that is transported in the first direction by the first transporting member in the second direction in a second transporting path that is formed in parallel with the first transporting path so as to supply to the developer bearing member, and turns up and transports the developer that is transported in the second direction by the first transporting member in the first direction in the second transporting path, the second transporting member being provided horizontally or approximately horizontally with respect to the first transporting member;

a partitioning plate that partitions the first transporting path and the second transporting path, and a resupplying port that resupplies the toner in a downstream side of the second direction in the first transporting path, wherein the developer that is transported by the first supplying portion and churned with the toner and the developer that is supplied to the first supplying portion by the second supplying portion face and collide with each other, further comprising a first slit provided in the partitioning plate at a first position where the developer transported in the first direction by the first transporting member is turned up, a second slit provided in the partitioning plate at a second position where the developer transported in the second direction by the first transporting member is turned up; and a third slit provided in the partitioning plate at a third position where the developer transported in the first direction and the developer transported in the second direction collide with each other.

2. The developing apparatus according to claim 1, wherein the first transporting member has an agitator for transporting the developer while churning, further comprising a plate that is provided near the third position where the developer transported in the first direction and the developer transported in the second direction collide, the plate being formed in an agitator groove to be extended radially from a center of an agitator shaft and arranged in parallel with the agitator shaft.

3. The developing apparatus according to claim 1, further comprising a wall having a surface perpendicular to the partitioning plate is provided at a position where the third slit is formed.

4. The developing apparatus according to claim 1, further comprising a plate that is provided in an upstream side of the third position where the developer that is transported by the first supplying portion and the developer that is transported by the second supplying portion collide with each other within the first transporting path, the plate being radially extended from a center of an agitator shaft at a portion of an agitator groove of the first transporting member or the second transporting member and arranged in parallel with the agitator shaft.

5. An image forming apparatus using the developing apparatus according to claim 1.

6. A developing apparatus comprising:

a first supplying portion that transports a toner that is resupplied and a developer that is stored in a developer vessel while churning so as to supply to a developer bearing member;

a second supplying portion that transports a waste toner that is different from the resupplied toner and passes a developing process and the developer while churning so as to supply to the first supplying portion, a first transporting member that transports the developer in a first direction in a first transporting path and in a second direction opposite to the first direction in the first transporting path;

a second transporting member that turns up and transports the developer that is transported in the first direction by the first transporting member in the second direction in a second transporting path that is formed in parallel with the first transporting path so as to supply to the developer bearing member, and turns up and transports the developer that is transported in the second direction by the first transporting member in the first direction in the second transporting path, the second transporting member being provided horizontally or approximately horizontally with respect to the first transporting member;

a partitioning plate that partitions the first transporting path and the second transporting path, and a resupplying port that resupplies the toner in an upstream side of the first direction in the first transporting path, wherein the developer that is churned with the toner that is transported by the first supplying portion and the developer that is supplied to the first supplying portion by the second supplying portion face and collide with each other, further comprising a first slit provided in the partitioning plate at a first position where the developer transported in the first direction by the first transporting member is turned up, a second slit provided in the partitioning plate at a second position where the developer transported in the second direction by the first transporting member is turned up; and a third slit provided in the partitioning plate at a third position where the developer transported in the first direction and the developer transported in the second direction collide with each other.

7. The developing apparatus according to claim 6, further comprising:

a filter member that is provided in the first transporting path that the developer is transported by the first transporting member in the second direction, and turned up, and then transported by the second transporting member in the first direction; and a resupplying port that resupplies a waste toner and is formed in an upstream side of a position where the filter member is provided within the second transporting path.

8. An image forming apparatus using the developing apparatus according to claim 6.

* * * * *